US008359679B2

(12) United States Patent
Martin

(10) Patent No.: US 8,359,679 B2
(45) Date of Patent: Jan. 29, 2013

(54) TOILET CLOG REMOVAL AND CLEANING SYSTEM

(76) Inventor: Donald L Martin, Cardiff, CA (US)

( * ) Notice: Subject to any disclaimer, the term of this patent is extended or adjusted under 35 U.S.C. 154(b) by 994 days.

(21) Appl. No.: 11/676,238

(22) Filed: Feb. 16, 2007

(65) Prior Publication Data

US 2008/0196150 A1 Aug. 21, 2008

(51) Int. Cl.
*E03D 9/00* (2006.01)

(52) U.S. Cl. ..... 4/255.01; 4/255.07

(58) Field of Classification Search ..... 4/255.01, 4/255.07, 300.3, 248
See application file for complete search history.

(56) References Cited

U.S. PATENT DOCUMENTS 5,768,719 A * 6/1998 Harvey ..... 4/255.01
6,138,289 A * 10/2000 Sardo ..... 4/248
6,804,838 B2 * 10/2004 Lacus ..... 4/255.01

* cited by examiner

*Primary Examiner* — Tuan N Nguyen

(57) ABSTRACT

A toilet clog removal device comprised of a collapsible high volume bellows that fits between a toilet seat and the rim of a toilet bowel. When a bellows is compressed with the toilet seat a positive pressure is generated in the toilet bowl and the clogging materials are pushed down. The bellows will also flush most of the water from a toilet, leaving a small amount of water in the toilet bowl allowing a toilet cleaner to be less diluted and thus more effective in cleaning a toilet. After use the bellows may be collapsed by twisting and folding for convenient storage.

2 Claims, 5 Drawing Sheets

TOILET CLOG REMOVAL AND CLEANING SYSTEM

FIELD OF INVENTION

The invention relates a toilet clog removal and cleaning system.

DESCRIPTION OF PRIOR ART

The prior art of plungers is well documented and understood. A plunger is a device which is essentially a stick or handle connected to an object which is generally shaped like a cup. The plunger is then placed into the dirty water of a clogged toilet bowl. With back and forth movement and some sloshing of toilet water, the clog is generally removed.

The more recent prior art of toilet clog removal by air pressure without contacting the toilet water is expressed in: U.S. Pat. No. 5,600,856 February 1997 Kang; U.S. Pat. No. 5,963,994 October 1999 Harvey; U.S. Pat. No. 6,643,854 November 2003 Jensen; and U.S. Pat. No. 6,804,838 October 2004 Lacus. These patents describe devices using a flexible material for a diaphragm, bonded to a flat rigid or semi-rigid surface. This flat surface is required to make a seal with the rim of a toilet bowl. These inventions, with their generally rigid flat surfaces require adhesives or other means to create a seal with the rim of a toilet bowl. These are generally described as follows: U.S. Pat. No. 5,600,856— . . . softer material than toilet bowl cover . . . weight placed on top side of the toilet bowl cover; U.S. Pat. No. 5,963,994— . . . substantially rigid lid coupled to a pliant top . . . ; U.S. Pat. No. 6,643,854— . . . sealing ring against the rim of the toilet forming a substantially airtight seal around the toilet bowl . . . ; and U.S. Pat. No. 6,804,838— . . . employing a sealing means to seal the edge of the diaphragm to the top ring of the fixture . . . . The need for a seal between the diaphragm and the rim of a toilet bowl is required in part to the relatively small volume of their diaphragms. The small volume must overcome the air leakage through the toilet overflow tube as well as the air leakage at the interface between these inventions and the rim of a toilet bowl. Furthermore U.S. Pat. No. 5,963,994 states "When a user presses the top 30 again, the cycle is repeated with the net effect that the pressure within the volume 20 increases with each pressing". This process does not occur. A toilet bowl will only sustain a transient increase in pressure as air is being supplied by a pump. This is due to the use of an overflow tube in a toilet's water tank reservoir which is designed to allow water to flow freely through the overflow tube and into the toilet bowl. This prevents a leaking water supply valve from overflowing a toilet's water tank reservoir, thus preventing a flood. Air freely flows through the same channels which would prevent any pressure buildup. U.S. Pat. No. 5,963,994 also states, "The toilet seat assembly 12 of the invention can include a latch 33, shown in FIG. 1A. Because the pressure within the volume 20 increases during the pumping action, a force will be generated against the seat assembly 12 and in a direction substantially opposite to the arrow 22. Thus, the increased pressure within the volume 20 sill (sic) tend to un-seal the seat assembly 12 against the rim 16. Accordingly, the latch 33 can be used to rigidly interconnect with the bowl 14 so as to resist the pressure forces within the volume 20. In one configuration, the latch 33 is arranged to hook around the surface of the bowl 14, such as shown in FIG. 1A. Alternatively, the bowl 14 can include a mating hook 33a which provides a mating structure for interconnecting with the latch 33." This would require either a redesign toilet bowl or adding a hook to a toilet bowl to aid in the use of this invention.

In addition the diaphragm and flat surface assemblies of these above mentioned inventions are at least as large as the rim of a toilet bowl with varying thickness depending on the specific design. Their relatively large size makes them less practical for use and storage by a typical home owner. The invention described in U.S. Pat. No. 5,963,994 is even less practical as this invention is an integral part of a toilet seat and every toilet in a household would need this invention.

Normal flushing of a toilet is caused by the rapid flow of the water from a toilet's water tank reservoir, here after referred to as a tank, into the toilet bowl. The rapid flow of water results in a siphon action in the toilet. This siphon action is the principal behind a toilet flush that removes the water and waste from a toilet bowl. The inability of a toilet to properly flush can occur when there is significant mineral buildup in the interior toilet structures. Mineral buildup can slow the flow of water from a toilet tank to a bowl. If the water flow is slowed enough, the siphon action of the toilet does not function properly. A toilet with excessive mineral buildup will often cease to flush properly. This can cause a backup or clog and may require multiple fillings from a tank to flush or may require other means to clear the backup or clog. There is a need for a device which can remove most of the water from a toilet bowl. With less water in a toilet bowl, toilet cleaning solvents are more concentrated and better able to remove mineral buildup.

Plumbers and others, who remove toilets, usually remove all the water from a toilet bowl and tank. This prevents the toilet water from sloshing or leaking out on to the floor as the toilet is removed. After turning off the water supply to the toilet, the toilet is flushed to remove the water from a tank. The water remaining in the toilet bowl must then be removed. Removing the remaining water from the toilet bowl is usually accomplished with buckets, cups, and sponges. A siphon may also be used. There is a need for a device which can remove most of the water from a toilet bowl to reduce the amount of time required to perform this task.

SUMMARY OF THE INVENTION

The present invention comprises a bellows for removing clogs from a toilet and removing most of the water from a toilet bowl.

a) A bellows that fits between a toilet seat and the rim of a toilet bowl.
b) A bellows is compressed with the toilet seat generating a positive pressure in the toilet bowl pushing the clogging material(s) from the toilet or removing most of the water in the toilet bowl.
c) A bellows that collapses for convenient storage and ready use.

Said bellows are preferably comprised of a bottom sealing surface formed from flexible, gas tight material secured at an outer peripheral edge to a first relatively rigid oval or circular frame or hoop where the hoop is equal to or greater in horizontal measure than an outside edge to a top rim of a toilet bowl. One or more openings are defined in the material of the bottom sealing surface for passage of bellows air into the bowl of the toilet. Sealed to the edges of the material of the bottom sealing surface and generally near the first hoop is an upward extending oval or round cross section of flexible gas tight material forming a compressible bellows membrane. Said membrane may be also be formed of a relatively more rigid material and have an accordion structure. Said membrane is divided into a rear section and a front section, where the rear section has a relatively short height compared with a height of the front section.

A top sealing surface, preferably similar in construction to the bottom sealing surface, is formed of from flexible, gas tight material secured at an outer peripheral edge to a second relatively rigid oval or circular frame or hoop. The upper edges of the membrane are sealed to peripheral edges of the top sealing surface. The combination of the bottom sealing surface, the membrane and the top sealing surface define an internal volume preferably more than 1.5 cubic feet, and more preferably more than 2.0 cubic feet. The cumulative area of the opening(s) in the bottom sealing surface are equal to at least 6 square inches.

The present invention may be arranged by a user in an inflated or deflated position. A deflated position of the bellows places the top sealing surface near or next to the bottom sealing surface, with the membrane collapsed or folded down so that an elevation of the bellows in the collapsed position is preferably no more than about 1 to 4 inches. A preferred method of moving the bellows to an inflated position requires that a user grasp an edge of the first hoop of the bottom sealing surface at the bottom of the front section and also grasp with another hand an edge of the second hoop of the top sealing surface at the top of the front section, whereafter the user moves the bottom sealing surface apart from the top sealing surface, inflating the internal volume with air through the openings. In a side view of the bellows in an inflated position, the bottom sealing surface and top sealing surface generally form a vertex of an expanded angle at the rear section of the membrane and an open part of said angle at the front section. The generally triangular structure of the bellows in the inflated position is adapted to be positioned so that its angle vertex is placed relatively close to or next to a hinge connection of a toilet seat to a rear surface of the toilet rim and the front section of greater height is positioned toward a front of the toilet rim with a front of the toilet seat elevated to accommodate placement of the bellows in the inflated position.

To use the bellows in pressurizing and expelling water from the toilet bowl, a user simply presses downward on the front edge of the toilet seat, which in turn contacts the top sealing surface and causes expulsion of air in the internal volume through the openings to pressurize the toilet bowl. While it is preferred that the bottom sealing surface have a gas tight seal to the toilet rim when a user presses down on the toilet seat, the volume of air in the internal volume is sufficiently great that substantial amounts of that volume can be lost to a relatively loose seal while accomplishing the desired clog dislodgement. The use of the toilet seat over a relatively long stroke moving the bellows from an inflated to a deflated position provides the user with exceptional control over delivery of air volume and toilet bowl pressure for dislodging a toilet line clog.

The present bellows invention has several objects and advantages over the prior art:

a) A self contained unit which functions by placement between the toilet seat and toilet bowl optionally without the need for any special seal or valve apparatus.

b) Collapses to approximately one third its diameter and less than one tenth of its expanded volume, to allow storage out of sight in many convenient locations, including behind a toilet tank. A bellows may be inserted into a pouch and can be easily taken on travel or stored in a tool box.

c) Is easily expanded and compressed for repeated use on tough clogs or to remove the maximum amount of water from the toilet bowl without resorting buckets and cups.

d) With most of the water in a toilet bowl remove, a toilet cleaner's concentration is increased. This increases the efficiency of a toilet cleaner's ability to remove mineral buildup and stains.

e) If it is desired to remove all the water from the toilet bowl, there is less water to remove. Manufacturer instructions for toilet bowl cleaners often mention that completely draining the toilet bowl may be necessary to remove tough stains.

DETAILED DESCRIPTION OF THE DRAWINGS

Figure 1A:
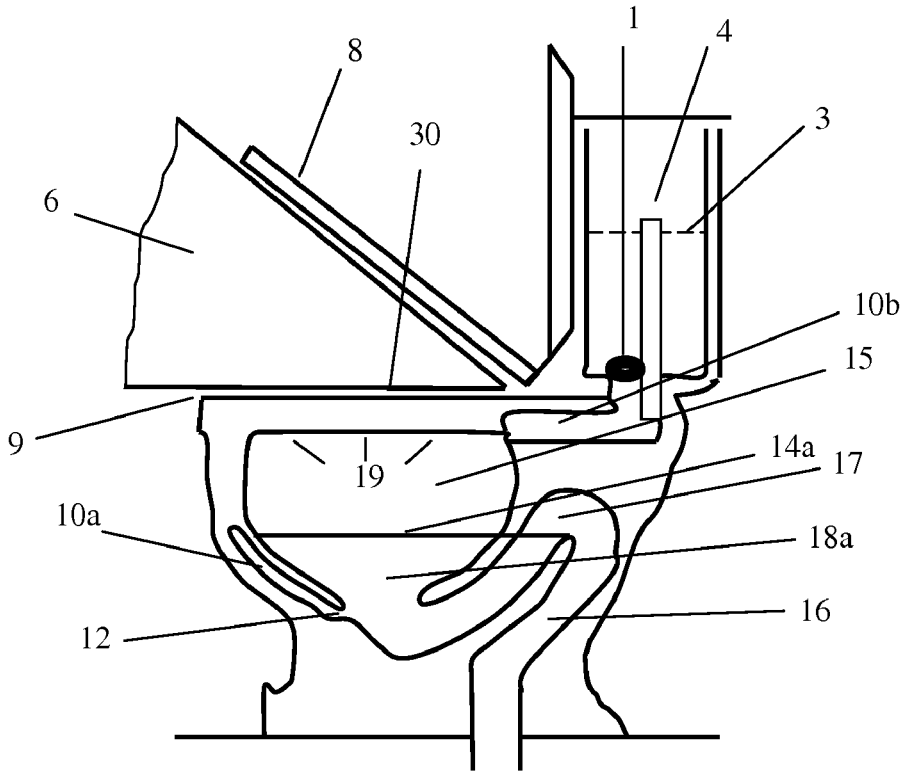
FIG. 1A is a side view of the invention bellows in an expanded position located so that its generally triangle structure fills a complementary triangular space between a toilet seat and a rim of a toilet bowl, where the toilet and toilet seat are shown in cross section.

FIG. 1A shows a bellows (6) expanded and situated between the toilet seat (8) and the rim of a toilet bowl (9). The typical full toilet bowl water level (14*a*), as well the typical toilet tank water level (3) is shown. The large volume of water in a full toilet bowl (18*a*) significantly dilutes toilet bowl cleaners, making them less effective. Also the removal of this large volume of water in a full toilet bowl (18*a*) is time consuming. The interior structures of the toilet where mineral buildup can occur are shown as (10*b*) and at the flush jet orifice (12). When a toilet is flushed the flapper valve (1) is raised and water comes through (10*b*) and (10*a*) and out the weep holes (19) to rinse the toilet bowl and the flush jet orifice (12). The rapid flow of water from a tank activates the siphon action of a toilet. This siphon action takes place below and behind the toilet bowl at (16), where the water falling down to the sewer pulls water from the toilet bowl. When the toilet is not being flushed the internal structure (10*b*) is a continuous air channel between the overflow tube (4) and the weep holes (19). This channel allows water which may come from a leaking water supply valve to flow into the toilet bowl instead of overflowing the toilet tank on to the floor. Any air pump device, e.g. diaphragm attached to a rigid plate, must be able to generate enough sustained pressure to overcome the air that leaks through this channel in addition to the air that leaks between the air pump and the toilet rim.

Figure 1B:
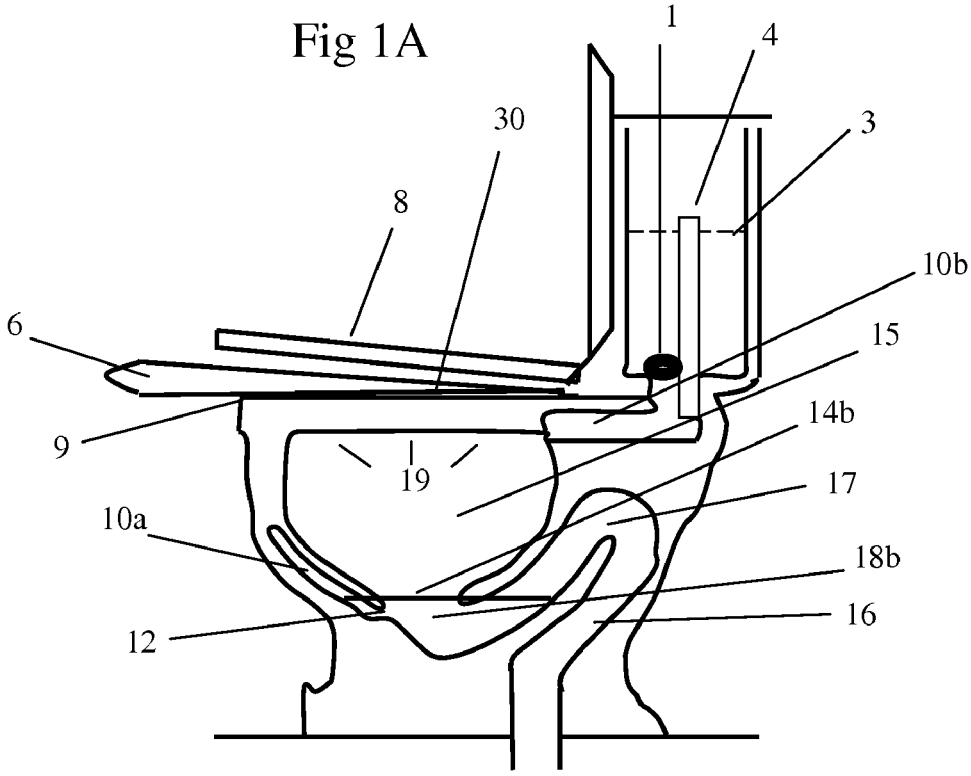
FIG. 1B is the bellows, toilet and toilet seat of FIG. 1A with the bellows in a deflated position.

FIG. 1B shows a bellows (6) compressed and situated between the toilet seat (8) and the rim of a toilet bowl (9). The inherent property of this bellows, i.e. its ability to be collapsed for convenient storage utilizes the toilet seat (8) to provide the necessary rigid surface area for the applied compression force to be transmitted to a bellows (6). A bellows is compressed by pushing down on the toilet seat (8). The compressed air passes through a hole in a bellows located at (30) and into the toilet bowl (15). A bellows (6) is able to maintain enough pressure to overcome the air that flows through the toilet bowl weep holes (19) to the overflow tube (4) due to its high volume and large hole (30). The air pressure generated pushes the clog down the toilet or removes most of the water in the toilet bowl. After the toilet bowl water or clog is removed the typical toilet bowl water level (14*b*) is shown. The small volume of toilet bowl water (18*b*) causes less dilution of toilet bowl cleaners, making them more effective. Also if it is desirable or necessary to remove all of the water from the toilet bowl e.g. in removing a toilet or applying toilet cleaner full strength, the removal of this small volume of toilet bowl water (14*b*) is less time consuming. The interior toilet structure most affected by mineral buildup and causing poor toilet flushing performance is the area around the flush jet orifice (12). Not only does much of the flushing water come through the flush jet orifice (12), but the flush jet orifice (12) provides momentum to the flushing waters to increase flushing efficiency. After a bellows is used to remove most of the water and toilet cleaner is added, the toilet bowl water level (14*b*) covers the flush jet orifice (12) with a more concentrated cleaning solution to remove mineral buildup and increase flushing efficiency.

Figure 2A:
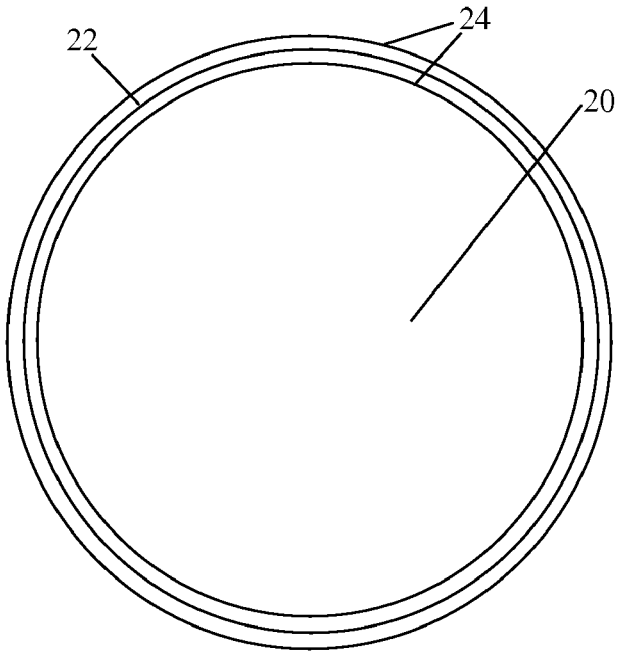
FIG. 2A is a top view of a top sealing surface or top membrane of the bellows of FIG. 1A.

FIG. 2A shows a bellows top membrane (20). FIG. 2A shows the location of a flexible hoop (22) and where a flexible hoop is sealed (24).

Figure 2B:
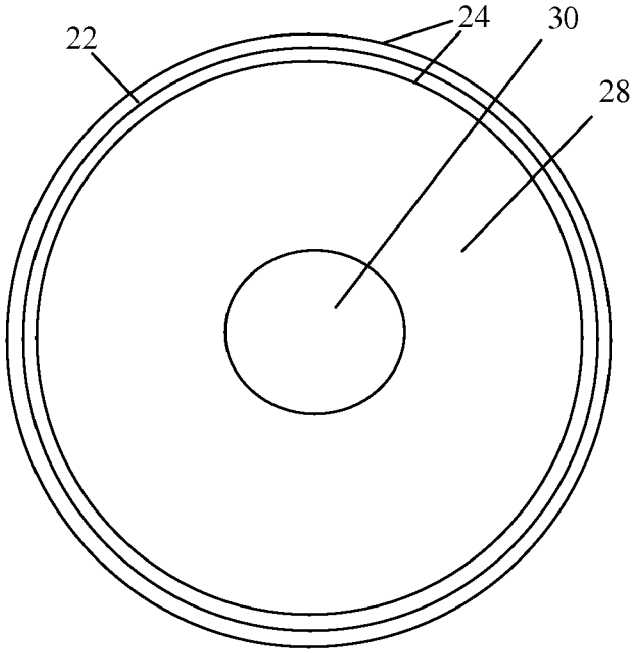
FIG. 2B is a bottom view of a bottom sealing surface or bottom membrane of the bellows of FIG. 1A.

FIG. 2B shows the location of a flexible hoop (22) and where a flexible hoop is sealed (24) and the hole (30).

Figure 2C:
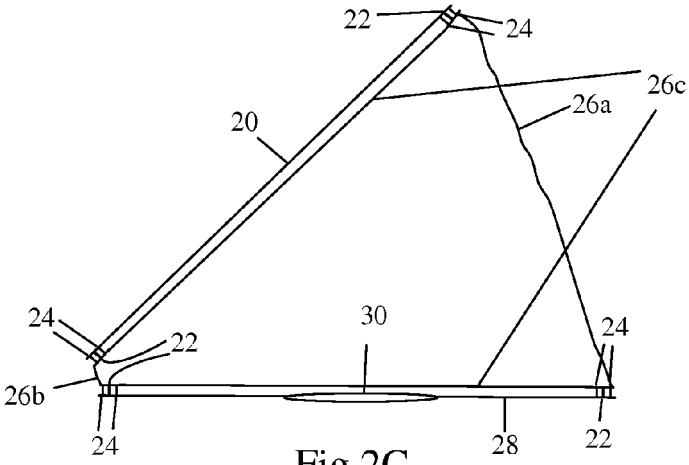
FIG. 2C shows a cross section of the bellows of FIG. 1A in an expanded position.

FIG. 2C shows a center cutaway side view of the three membranes top (20), middle (26*a,b,c*), bottom (28), and two flexible hoops (22). The two flexible hoops (22) are located just inside the perimeter of the top membrane (20) and bottom membrane (28). With each membrane (20) and (28) attached to opposite sides of the middle membrane (26*c*). The middle membrane is narrow (26*b*) where a bellows sits at the base of a toilet seat. The middle membrane gets widest at (26*c*) to allow a bellows to expand to a high volume.

Figure 2D:
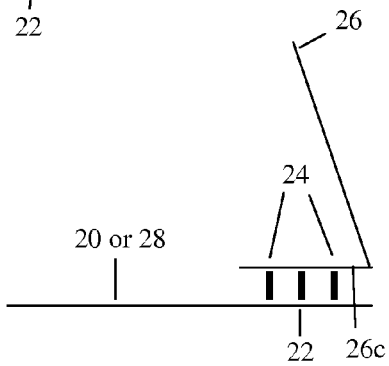
FIG. 2D is a side view of a cross section of a portion of the bellows of FIG. 1A illustrating a method to construct the bellows.

FIG. 2D shows an attachment method (24) to attach three membranes of a bellows (top (20), middle (26*c*), and bottom (28) membranes) to a flexible hoop (22).

Figure 2E:
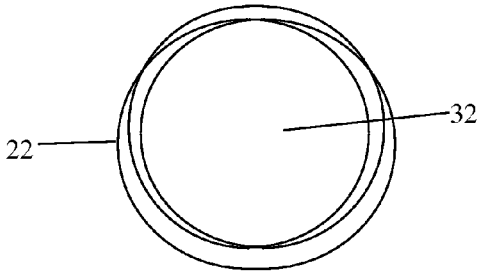
FIG. 2E is a top view of the bellows of FIG. 1B in a deflated position.

FIG. 2E shows the approximate size (32) of a bellows in its compact collapsed form. The collapsed form is achieved by twisting and folding the flexible hoops (24) which collapse the high volume bellows. Only one flexible hoop (24) is shown for clarity. Both hoops, along with the membranes fold together when a bellows is collapsed then twisted and folded. A preferred method for moving the bellows shown in FIG. 1B to the position shown in FIG. 2E is now described. A user will use one hand to grasp edges of both the first and second hoops at the rear section of the bellows and a second hand to grasp edges of both the first and second hoops at the front section. The user will rotate their hands in opposite directions, causing the first and second hoops to form a figure eight. The user will then move one hand in an arc toward the other hand until front and rear sections of both the first and second hoops are adjacent. The bellows in this position will occupy generally one half the horizontal area of the bellows shown in FIG. 1B.

Figure 3:
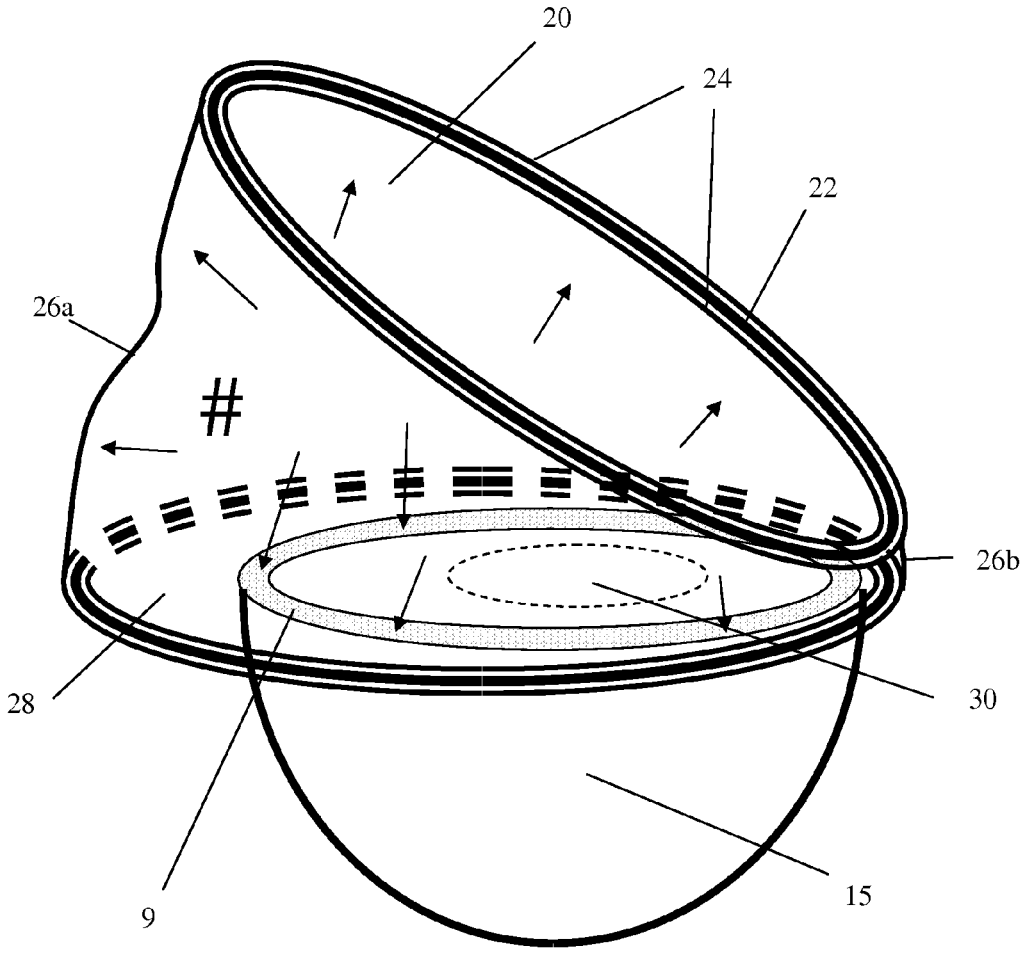
FIG. 3 shows a top perspective view of the bellows of FIG. 1A with showing a portion of the toilet bowl.

FIG. 3 shows an isometric view of a bellows expanded and resting on the rim (9) of a toilet. The toilet seat is not shown for clarity. The toilet seat is pushed down with a bellows in place. The pressure rises in the interior of a bellows and air escapes from the hole (30) into the toilet bowl (15). The arrows indicate the internal air pressure pushing outwards in all directions. This air pressure also pushes a bellows against the rim (9) of the toilet bowl (15) providing a good seal.

The current embodiment of a bellows is constructed of vinyl membranes (20), (26), (28), where membranes (20) and (28) are oval, and two flexible hoops (22) are made of spring steel. The two spring steel hoops (22) are heat sealed (24) between the membranes (20), (26) and (28), as shown in FIGS. 2C and 2D. Any number of smaller holes may be used to replace the single hole (30). Another embodiment could be with a single flexible hoop, but the expansion and compression of this type of bellows is more difficult to use than a bellows constructed with two flexible hoops.

A bellows may be constructed of numerous non porous membrane and flexible hoop materials. These materials may be assembled by many methods other than being heat sealed as evidenced by the numerous collapsible products on the market today, e.g. car window shades, tents, laundry bags, etc. These products use various flexible membrane materials e.g. nylon attached to flexible hoops made of various materials e.g. fiberglass using various attaching methods e.g. sowing thread.

Figure 4A:
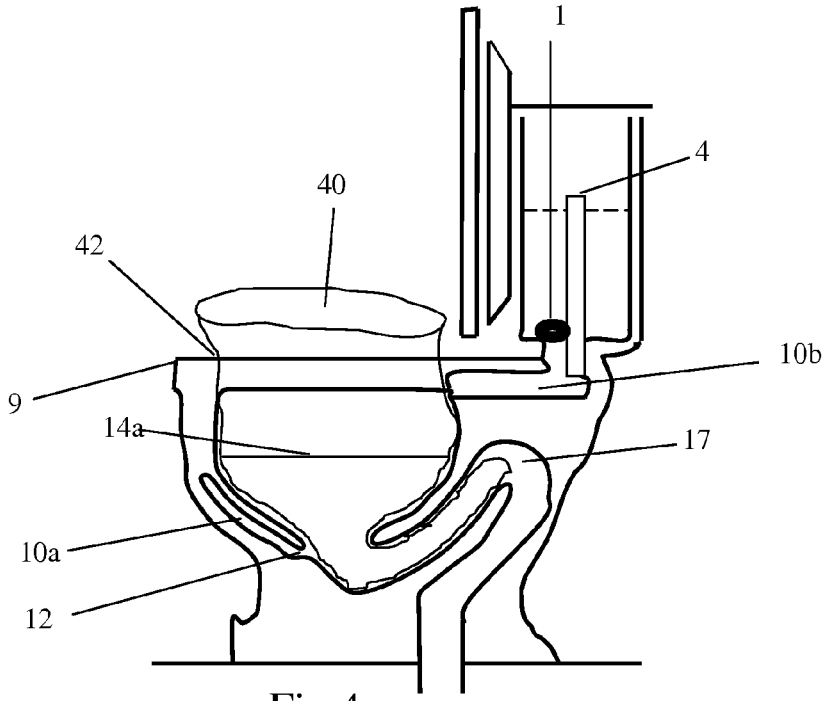
FIG. 4*a* is a side view of the toilet of FIG. 1A illustrating use of means for displacing water from a toilet bowl and/or to add a toilet cleaner.
Figure 4B:
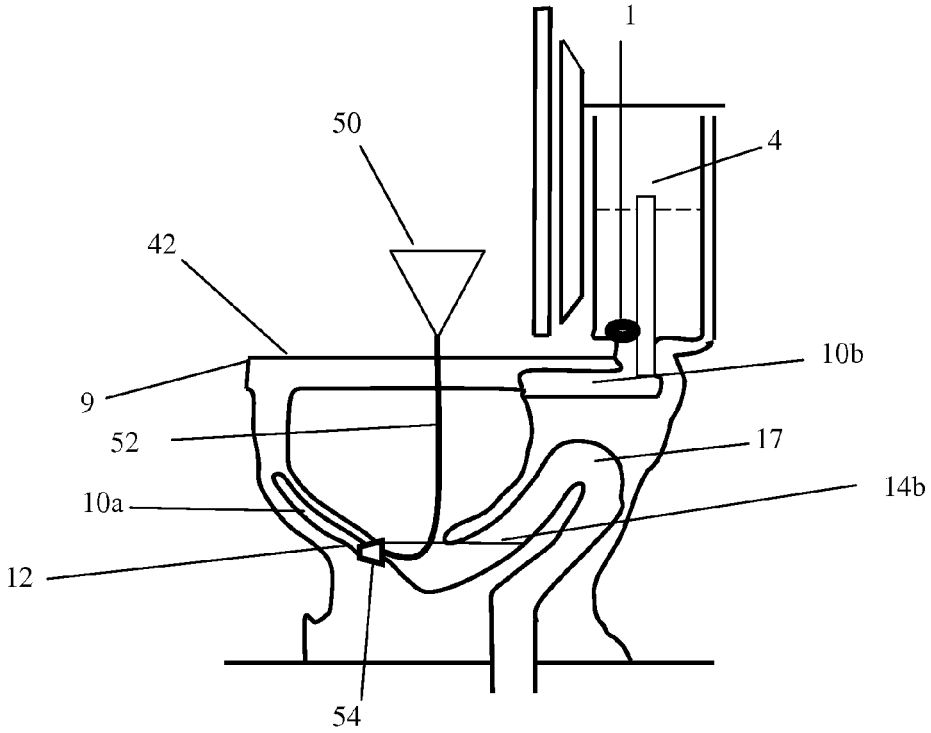
FIG. 4*b* is a side view of the toilet of FIG. 1A illustrating use of means for delivering toilet cleanser to a generally inaccessible portion of the toilet.

There are many adjuncts that may be used to aid cleaning both the interior toilet structures of a toilet (10*a*) and the flush jet orifice (12) shown in FIGS. 1A and 1B and the visible toilet bowl surface which the typical home owner wants to be stain free. When most of the water from a toilet is removed a siphon may be used to remove the remaining water in the toilet bowl. This siphon could either drain outside the toilet or may drain down the back side of the toilet (16) shown in FIGS. 1A and 1B. Many methods can be conceived for various objects to displace the water in the toilet bowl FIG. 1A (14*a*) or FIG. 1B (14*b*) to allow concentrated toilet cleaner to affect more of the surface area in the interior toilet structures (10*a*) and (10*b*) shown in FIGS. 1A and 1B. One method as shown in FIG. 4*a* could be a flexible bag (40) e.g. a 30 gallon garbage bag, inserted into the toilet bowl all the way to region (17) and be filled with water either part way to the level indicated by the water in the toilet bowl at (14*a* or 14*b*) or could be filled completely to the rim of a toilet bowl at (9). Either level of filling would displace all of the water in the toilet bowl. Toilet cleaner could then be introduced into the toilet bowl by either pouring it outside of the plastic bag (42) or down the overflow tube (4) to fill the voids in interior toilet structures of a toilet (10*a*) and (10*b*) and the flush jet orifice (12) with full strength toilet cleaner. Alternatively as shown in FIG. 4*b* a toilet cleaner could be poured into a funnel (50), connected to a tube (52), connected to a plug (54), and inserted into the flush jet orifice (12) to expose the interior of a toilet (10*a*) to the concentrated cleaner. This would not be a normal chore for a typical household but could be used to remove mineral buildup from all the interior structures of a toilet. This is significant benefit as some toilets are discarded when their interior structures are so full of mineral buildup they no longer function properly.

I claim:

1. A bellows adapted to pressurize a toilet bowl of a toilet and thereby dislodge a clog in a conduit connected with said toilet comprising:

a) a bottom sealing membrane comprising a bottom flexible material supported from a first hoop secured to a periphery of said bottom flexible material, where one or more flow openings are defined in the bottom flexible material;

b) a top sealing membrane comprising a top flexible material supported from a second hoop secured to a periphery of said top flexible material;

c) a side membrane comprising a side flexible material securely connected to the periphery of the top sealing membrane at a first end and extending down to be securely connected with the periphery of the bottom sealing membrane at a second end, where a rear section of the side membrane has a height substantially less than a height of a front section of the side membrane and the rear section is opposite the front section;

d) the top sealing membrane, the bottom sealing membrane and the side membrane define an internal volume which is inflated with air from atmosphere and expelled thereto through the flow openings.

2. Wherein the flexible material bellows as defined in claim 1 allows said bellows to be converted or transformed into a compact form.

* * * * *